United States Patent [19]

Callaghan et al.

[11] Patent Number: 4,877,269

[45] Date of Patent: Oct. 31, 1989

[54] BOARD BOOK FOR PRESCHOOL CHILDREN

[75] Inventors: Jean D. Callaghan, 1332 59th Pl., LaGrange, Ill. 60525; Robert J. Lane, Lake Bluff, Ill.

[73] Assignee: Jean Davis Callaghan, LaGrange, Ill.

[21] Appl. No.: 124,619

[22] Filed: Nov. 24, 1987

[51] Int. Cl.[4] ..... B42F 1/06; B42D 5/00; B42D 1/08; B42D 1/00

[52] U.S. Cl. ..... 283/40; 281/22; 281/38; 281/15.1

[58] Field of Search ..... 281/15 R, 22, 38; 283/40, 42, 50, 63 R, 38; 446/147; 270/5, 8, 32; 493/355, 356, 360

[56] References Cited

U.S. PATENT DOCUMENTS

| | | | |
|---|---|---|---|
| 335,683 | 2/1886 | Chapman | 281/22 |
| 467,851 | 1/1892 | Bowman | 281/15 R |
| 928,518 | 7/1909 | Howell | 281/22 |
| 934,311 | 9/1909 | Hoberg | 281/22 |
| 1,011,651 | 12/1911 | Stavens . | |
| 1,018,641 | 2/1912 | Strayer | 281/38 |
| 1,539,164 | 5/1925 | Curtis | 281/15 R |
| 1,640,246 | 8/1927 | Murray | 281/38 |
| 1,852,963 | 4/1932 | Fladmark | 281/15 R |
| 2,193,545 | 3/1940 | Ainsworth | 281/22 |
| 2,310,725 | 2/1943 | Widder et al. . | |
| 4,714,275 | 12/1987 | Engel et al. | 281/15 R |

FOREIGN PATENT DOCUMENTS 816250 8/1951 Fed. Rep. of Germany ..... 281/22

*Primary Examiner*—Frank T. Yost
*Assistant Examiner*—Paul M. Heyrana, Sr.
*Attorney, Agent, or Firm*—Mann, McWilliams, Zummer & Sweeney

[57] ABSTRACT

A board book for preschool children comprising a plurality of generally quadrilateral panels in side-by-side, congruent, stacked, relation, to define the book top edging, outside edging, bottom edging, and inside edging, with the panels being bound together at their inside edges to form the book spine, and for connecting consecutive of the book panels to the book spine for, when the book lies flat, approximate 180 degree free swinging movement relation relative to the book spine from positioning at one side of the book spine to the other side of the book spine, in paging the consecutive panels through the book, with the book front and rear panels being similar in fabrication to the book intermediate panels, and with those of the book panels following the book front panel, at their respective outside edges, being consecutively progressively indented toward the book spine, through the book rear panel, for, when the book lies flat, as on its rear panel, permitting a preschooler to readily page through the book using an open hand to flip over the book panels in consecutive order, one panel at a time, as he works through the book.

7 Claims, 5 Drawing Sheets

BOARD BOOK FOR PRESCHOOL CHILDREN

This invention relates to a board book, and more particularly, to a board book specifically adapted for use, including paging, by young children, such as preschoolers in the six month to four year age group, without requiring adult assistance.

In recent years there has been an increased emphasis on devising ways and means to start the learning of children at a very young age with reference to reading, expression, overall body coordination, and the like. Efforts to start preschool age children learning early have been wide-spread, in order to acquaint preschoolers with reading, drawing, and correct speech, as well as inducing the physical coordination required to perform these activities, by the time they are ready for formal schooling (such as public school kindergarten or its equivalent).

The present invention is directed to the structural features for a book that, in terms of word printing, art work, or some suitable combination of same, is oriented to encourage the natural intellectual curiosity of preschoolers, as well as inducing the youngster to learn to read simple words, appreciate their meaning in the context of the setting in which they are presented, and to develop the physical coordination that is involved in paging through a book of this type to view successive presentations that are available for viewing by paging through the book.

A principal object of the present invention is to provide a book arrangement specifically adapted for the young child in the preschool category that can be paged by the child free of all adult assistance, and that as the child pages through the book from the front to the rear of same, the consecutive pages move from a closed to an open position over the book spine and fall flat so that when the book pages are consecutively moved from a closed to an open position, the child has a full spread space before him to which may be applied printed matter in the form of a word or words, art work, or a suitable combination of same, that will be of interest to the young child.

Another principal object of the invention is to provide a board book arrangement made up of panels that generally are of the same size, that are free of flexibility or are at least relatively stiff, and are conventionally bound together along the inside edging of the book panels to define the book spine, with paging through the book, when the book as closed lies flat on its rear cover, involving swinging of the consecutive panels without the child having to use both hands to hold the book panels involved across the then opened portion of the book, in flattened relation, with the book panels following the book front cover being consecutively progressively indented toward the book spine an incremental amount to permit the preschooler to page through the book using an open hand in consecutively shifting the book panels from the page closed to the page opened position.

Yet another object of the invention is to provide a sequential learning aid for preschool age children in the form of a board book that allows the youngster to readily turn the consecutive book pages between their closed and opened relations, that permits the individual pages of the book to be turned without actually gripping the page that is to be turned, that as part of the page turning action involved, the page being turned falls flat and stays flat, and in substantial alignment with the front side of the next succeeding page, for providing a full spread space, made up of the back or rear side of the freshly turned page and the front side of the next succeeding book page, for displaying printed matter in the form of a word or several words, art work, or a suitable combination of same that will engage the youngster's attention and thereby encourage sequential learning in line with the building block approach.

Still other objects of the invention are to provide a board book for preschool age children that offers not only sequential learning but also induces physical coordination in being used by the young child, as well as induces interest in reading and understanding simple words, that provides an easily handled implement for placing before the preschooler a wide variety of printed matter in the form of one or more simple words and/or attractive art work, or a suitable combination of same, that does not require adult assistance for the youngster to pursue, and that is economical of manufacture, easily understood in terms of use and operation by the normal preschooler, and that is long lived in use.

In accordance with the present invention, a board book for preschool children is provided, for inducement of physical coordination and learning skills, comprising in the closed relation of the book, a plurality of generally quadrilateral panels in side-by-side, stacked and congruent relation, with each of the book panels defining a top edge, an outside edge, a bottom edge, and an inside edge. The front and rear covers for the book comprise the panels at the front and the rear of the book, and the panels are bound together at their inside edges using conventional board book binding procedures for this purpose, to form the spine of the book and for swingably connecting consecutive of the book panels to the spine for, when the book in closed relation lies flat on its rear cover (and thus is disposed substantially horizontally), approximate 180 degree free swinging movement of the consecutive book panels relative to the book spine from positioning at one side of the book spine to the other side of the book spine, in paging the consecutive book panels through the book. The book itself has a closed relation in which it defines a top edging, an outside edging, a bottom edging and an inside edging that forms the book spine.

The board book of the invention has an open relation for its respective panels in which the individual panels of same that are swung relative to the book spine to form a particular book open relation, lie flat, face upwardly and are also disposed in substantial coplanar relation with respect to the next adjacent unopened panel, after such swinging so that the back or rear side of the swung or open panel and the front side of the next adjacent panel, are both exposed for viewing and available across the width of both panels involved for application thereto of printed matter in the form of one or more simple words and/or art work for providing an on-going presentation that will be of interest to the youngster and encourage sequential learning, with those of the book panels following the first panel of the board book at their respective outside edges, and at the outside edging of the book, being consecutively progressively indented toward the book spine in an incremental manner and through the last of the book panels including its rear cover to define for each indented panel a recess edging exposing from the rear of the book a panel turning edging portion of the panel preceding same in the book, with the panel turning edging portions being aligned transversely of the book, and with the panel recess edgings and panel turning edgings permitting ready engagement of the consecutive book panels to consecutively swing them to form the consecutive book open relations that the book provides for.

The result is that when the board book of the invention is lying flat and resting in the book closed relation, on the book rear panel cover (as on a table or the floor and thus in an essentially horizontal position), the book panels, starting with the book front cover panel, may be consecutively swung to form the book open relation defined by same and fall flat therein, using the recess edging of the panel following the panel that is to be swung as indicated, and the panel turning edging of the book panel to be so actuated, and in the open relation of the book the adjacent of the book panels that define the book open relation both lie flat and are in substantial coplanar relation free of manual hold down of such adjacent panels of the book, for ready inspection of the printed indicia and/or art work imprinted thereon across the width of the book in the book open relation. Successive of the book panels to the rear cover of the book are paged in the same manner successively to expose in a similar manner the printed indicia and/or art work that is imprinted on the successive upwardly facing sides of adjacent panels of the book.

Other objects, uses, or advantages will be obvious or become apparent from a consideration of the following detailed description and the application drawings.

Figure 6:
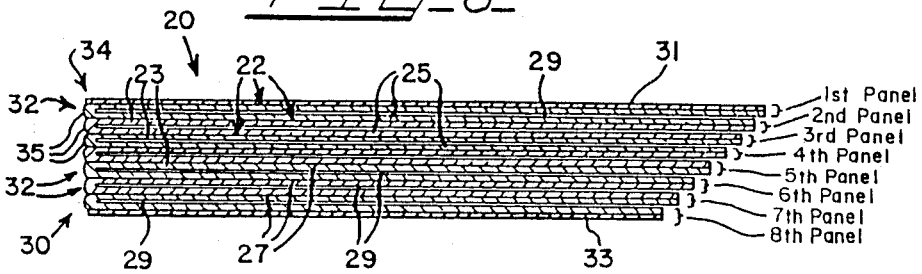
FIG. 6 is a large scale diagrammatic view illustrating the conventional layering that is commonly employed in board books in forming the panels thereof, with FIG. 6 being taken substantially along line 6—6 of FIG. 1.
Figure 7:
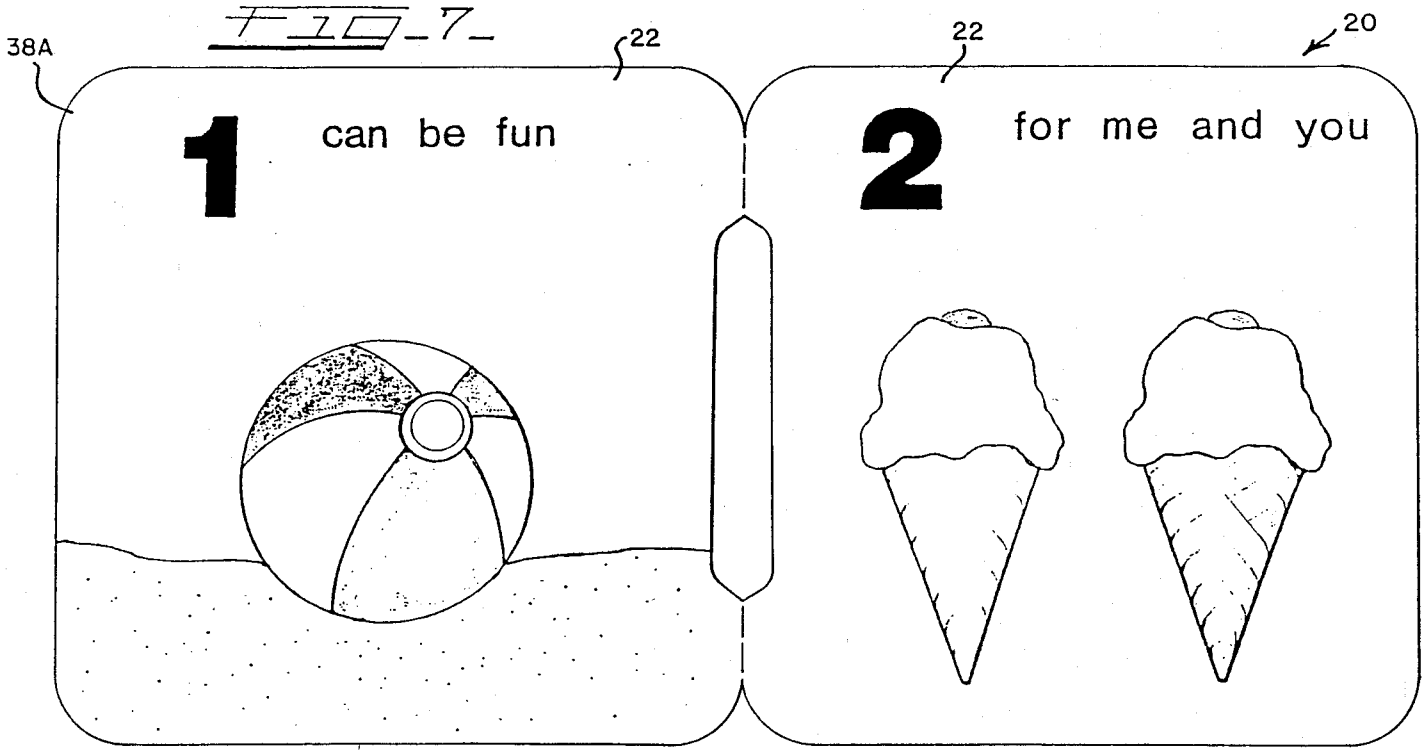
FIG. 7 shows the book of FIGS. 1-6 in its book open relation in which the book panel forming the front cover is swung from the closed position of FIGS. 1-5 to a book open relation, to expose printed indicia and art work on the rear face of the panel forming the book front cover, and printed indicia and art work of the front face of the next adjacent book panel.
Figure 8:
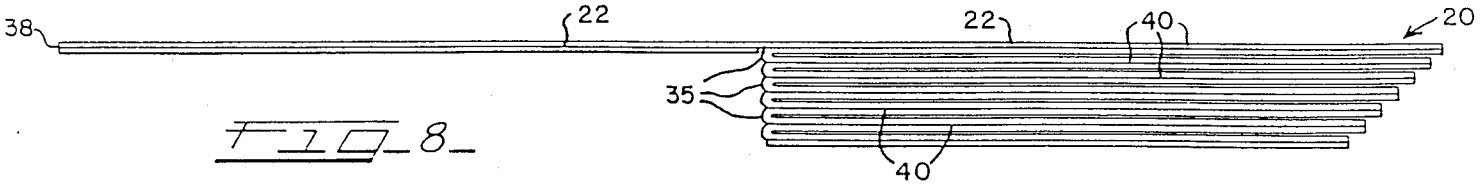
Figure 9:
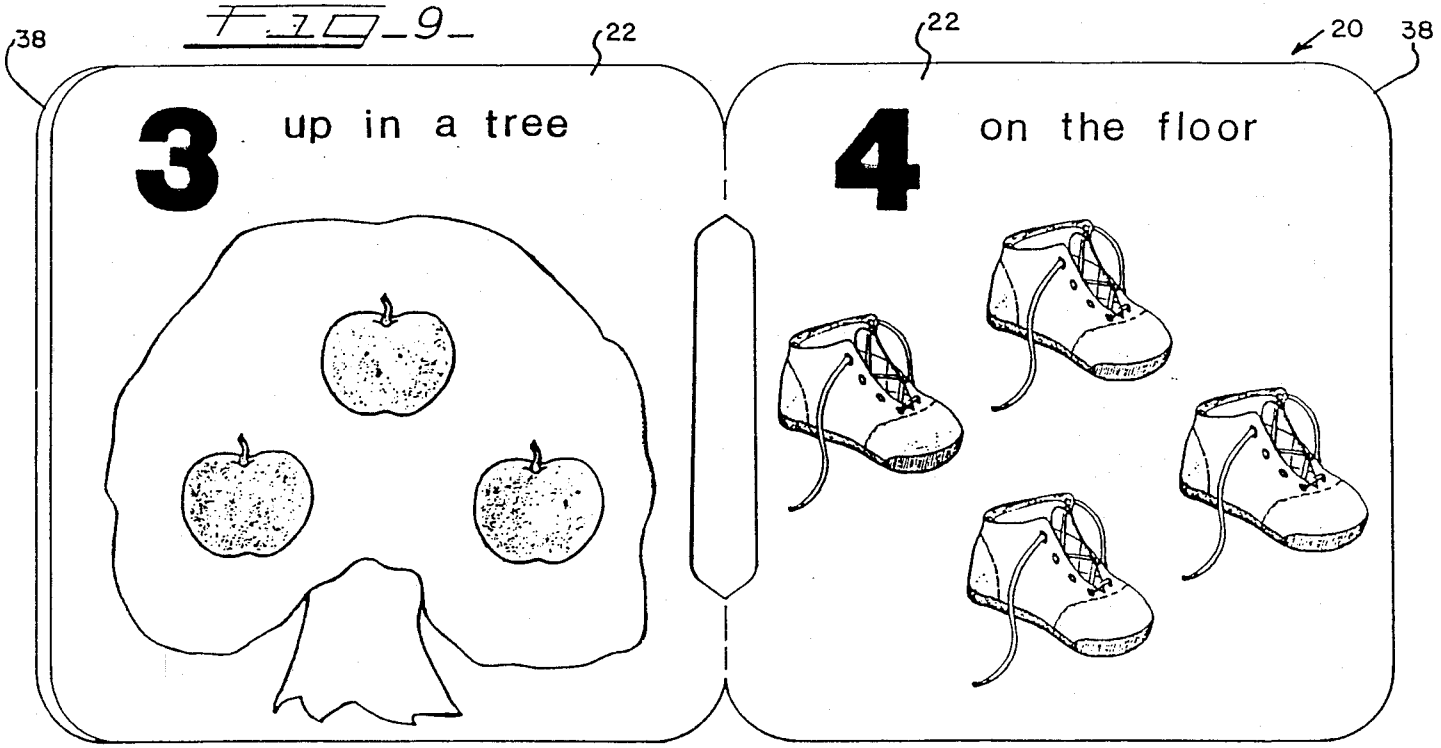
Figure 10:
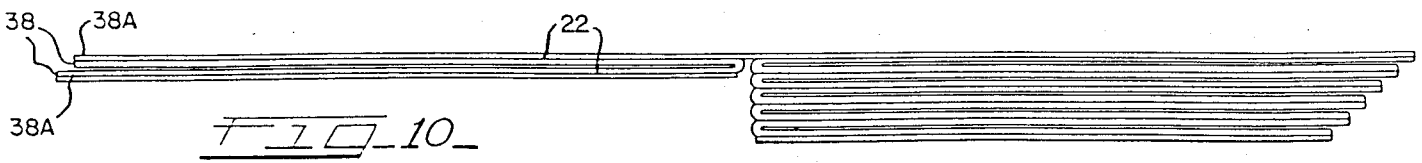
Figure 11:
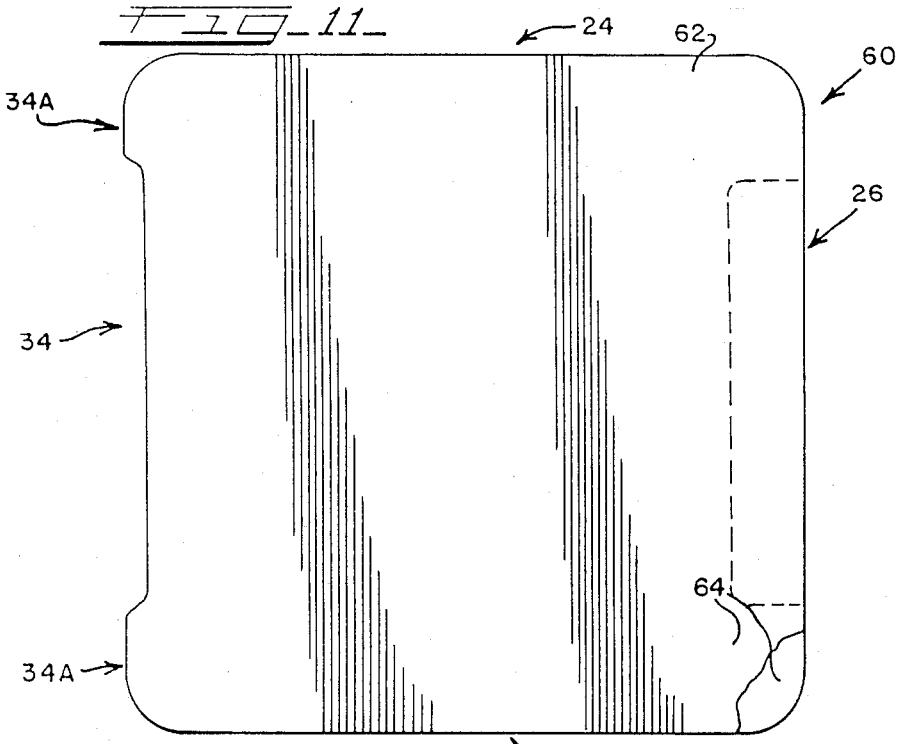
Figure 12:
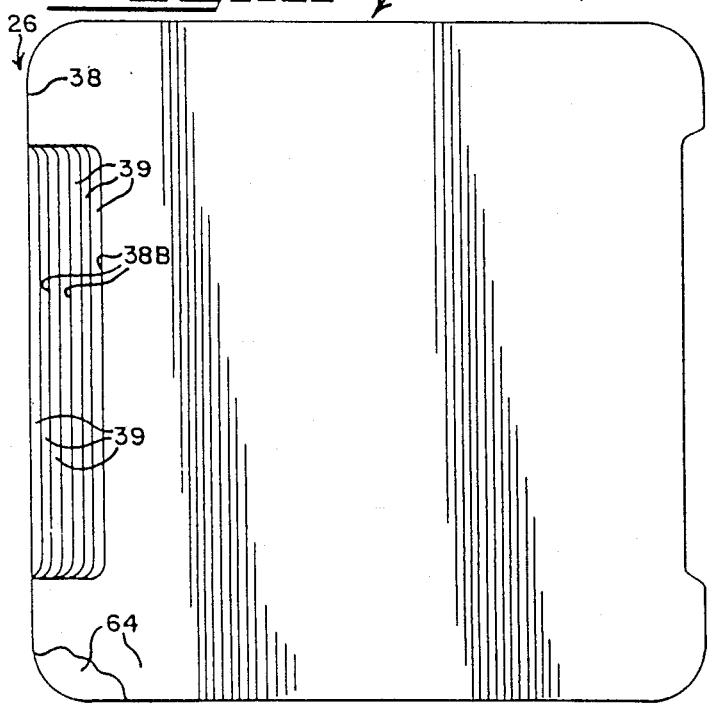

FIG. 8 is a diagrammatic bottom plan view of the book of FIGS. 1-7 in the open relation shown in FIG. 7 (it being understood that a plan view of the top edge of the book in the open relation of FIG. 7 would be similar but inverted, indicating the substantial coplanar relation that the book adjacent panels forming the open relation of the book have when the board book of the present invention is opened up;

FIG. 9 is a view similar to that of FIG. 7, but illustrating the next adjacent book panel, namely the book panel front face that is shown in plan at the right side of FIG. 7, turned over at its swinging connection to the book at the book spine, to expose the back side or face of such book panel, as well as the front side or face of the next adjacent book panel, which, in the form illustrated, each bear an illustration that is designed to induce the attention of preschool children;

FIG. 10 is a bottom plan view of the book of FIGS. 1-9, with the book open to the position shown in FIG. 9, indicating the relative positioning of the book panels on either side of the book spine (it being understood also that the top plan view of the book disposed as indicated in FIG. 8 would be similar but inverted);

FIG. 11 is a front plan view of a modified form of board book arranged in accordance with the principles of the present invention, in which the outside edging of the book is at the right hand side of FIG. 11 and the book spine is at the left hand side of FIG. 11;

FIG. 12 is a rear plan view of the book shown in FIG. 11; and

Figure 13:
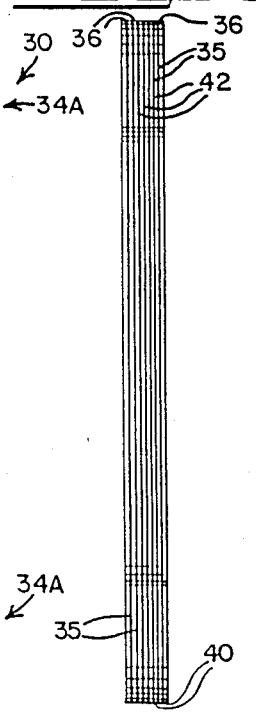

FIG. 13 is a side elevational view of the spine of the book of FIGS. 11 and 12, with the spine that is illustrated being shown at the right hand side of FIG. 11.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 20 of FIGS. 1-10 indicates one embodiment of board book arranged in accordance in the present invention, which comprises a plurality of panels 22 that are of the board book type. In the board book 20, each the book internal panels 22 are formed by a suitable laminated paperboard sheet 23 (see FIG. 6) doubled over to define opposite layers or leaves 25, with the layers or leaves 25 of adjacent sheets 23 that are in face to face relation being suitably bonded together (using adhesive or the like and standard board book making methodology), as indicated at 27, to form the individual panel 22, but with the layers or leaves 25 of each such sheet 23 that face each other being unbonded, as, indicated at 29. The front cover 31 and the adjacent layer or leaf 25 (of the top sheet 23 shown in FIG. 6) are bonded together in the same way to form a front panel 22, as are the rear cover 33 and the layer or leaf 25 (of the bottom sheet 23 shown in FIG. 6) adjacent same, to form the rear panel 22. Thus, the two bonded together layers or leaves 25 of adjacent sheets 23 form the respective internal panels 22, while the front cover 31 and the layer or leaf 25 of the folded sheet 23 adjacent same form the front panel 22; similarly, the rear cover 33 and the layer or leaf 25 of the folded sheet 23 adjacent same form the rear panel 22.

The preferred laminated paperboard sheet 23 is a clear dry Mylar film, or is equivalent, for strength. The Mylar film laminate is applied to the smooth, printed surface, of the paperboard prior to the duplex glued binding procedure that is referred to hereinafter.

The board book 20 and its panels 22 in the closed relation of the book 20, are in the familiar panel side by side, essentially stacked, and congruent board book forming relation (see FIGS. 1–6) and thus define the book top edging 24, the book outside edging 26, the book bottom edging 28 and the book inside edging 30, at which the book panels 22 are hinged together to open up in one open relation of book 20, in the manner indicated in FIGS. 6–10, utilizing conventional board book binding procedures for this purpose.

In the form of FIGS. 1–10, the individual panels 22 are each formed as indicated and are thus hinged together, as at 32, at the book inside edge 30 in the board book conventional manner illustrated in FIG. 6; this hinges the adjacent panels 22 together at the book spine 34 defined by the book inside edging 30. The result is that adjacent panels 22 are hinged together to swing about the fold 35 of each sheet 23, which folds 35 parallel the book spine and indicate the respective open relations of the book. The folds 35 and related structure are shown somewhat oversize in FIG. 6 to indicate their locations relative to the book panels 22.

In the several forms of the invention that are shown in the application drawings, the panels 22 thereof are generally quadrilateral (approximately square) in configuration, and the overall front and rear panels 22 form the front and rear covers of the book. Of course, other quadrilateral shapings and even round shapings can be employed, consistent with the invention.

As indicated in the showing of FIGS. 1–9, each panel 22 defines a top edge 36, outside edge 38, bottom edge 40, and inside edge 42.

It will thus be seen that the folds 35 are located at the inside edges 42 of the respective panels 22.

In addition, the spine 34 of the book is indented toward the outside edging 26 of the book 20 so that the cardboard sheets 23 that each form about one-half of the adjacent pairs of panels 22 swing about the indicated fold lines 35 at the spine upper and lower sections 34A.

Figure 2:
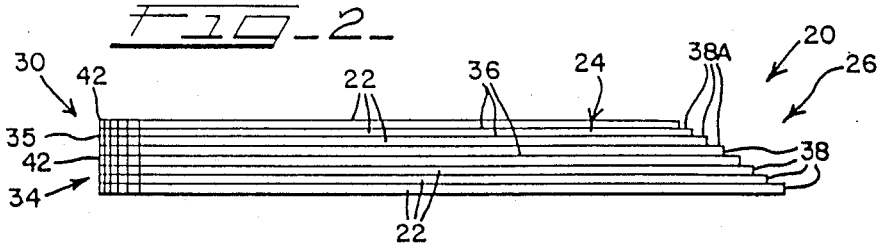
FIG. 2 is a diagrammatic top plan view of the top edging of the book as shown in FIG. 1, with the book spine being at the left hand end of FIG. 2 and the book front edging being at the right hand end of FIG. 2, and showing also the top edges of the panels making up the book of FIGS. 1 and 2.
Figure 1:
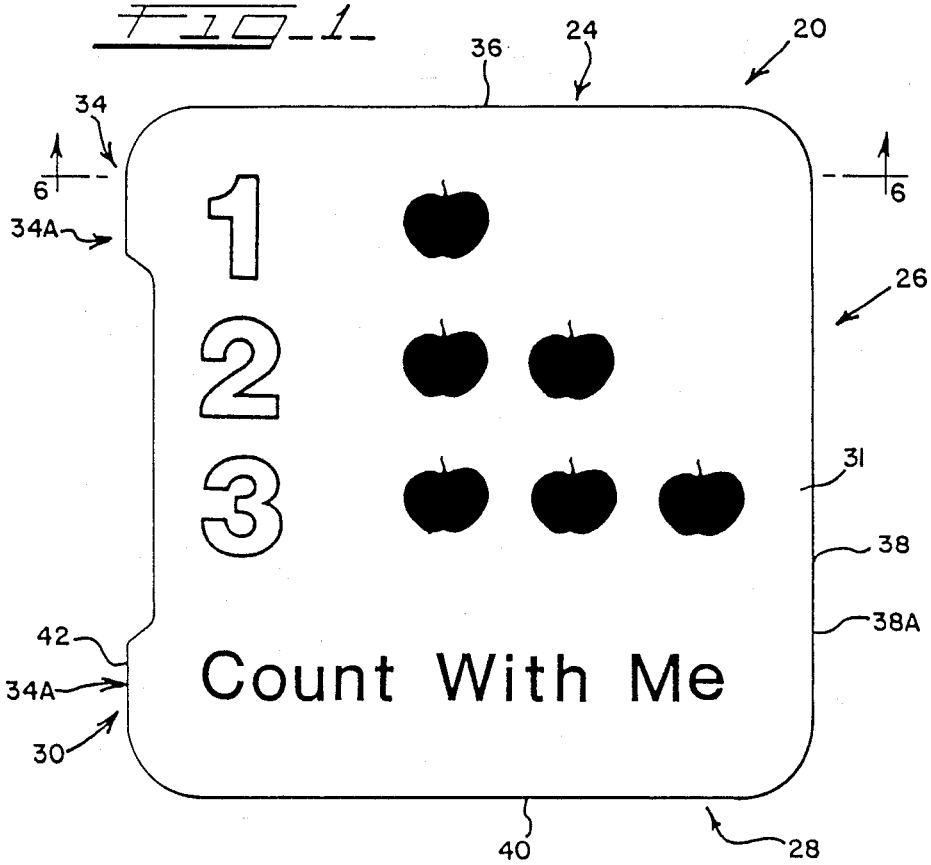
FIG. 1 is a front plan view of one embodiment of the board book of the present invention, showing on the book panel that forms the front cover of the book a sampling of what the book contains, using common and simple words as the printed matter, and diagrammatically illustrated art work on the front face of the book front panel.
Figure 3:
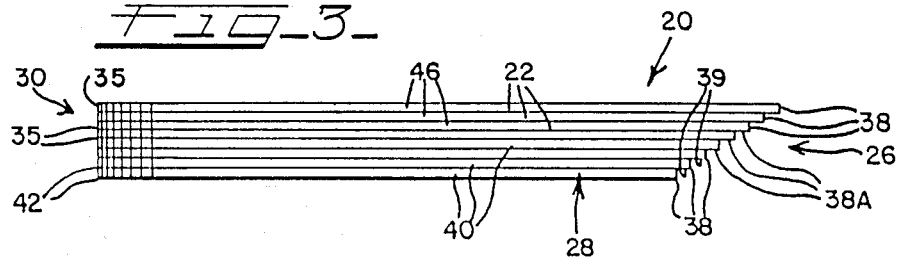
FIG. 3 is similar to that of FIG. 2, but is a bottom plan view of the book shown in FIG. 1, showing also the bottom edges of the panels making up the book of FIGS. 1-3.
Figure 4:
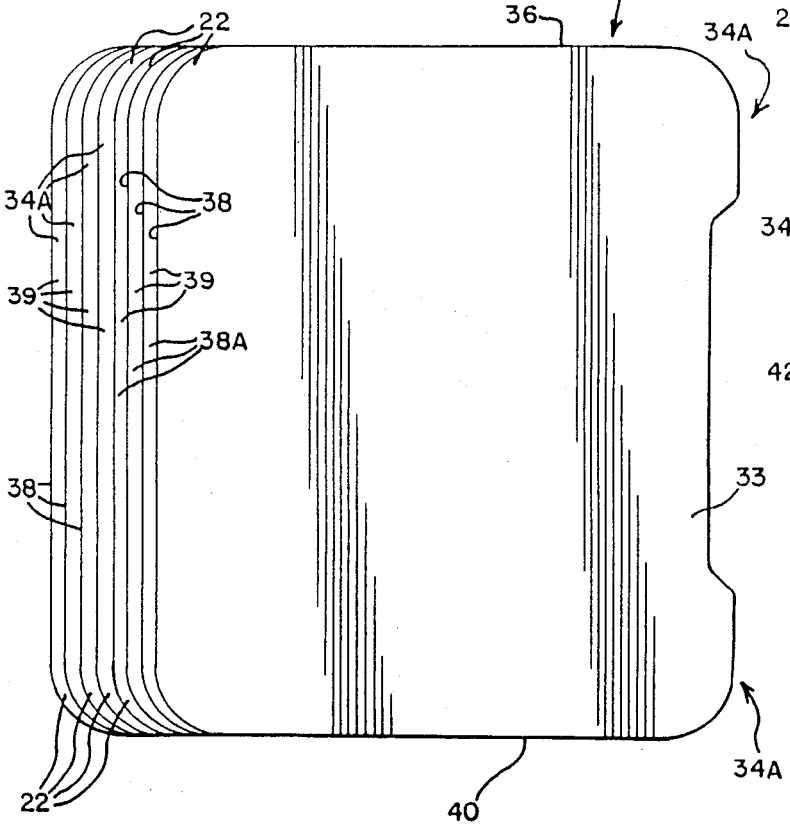
FIG. 4 is a rear plan view of the board book as shown in FIG. 1.
Figure 5:
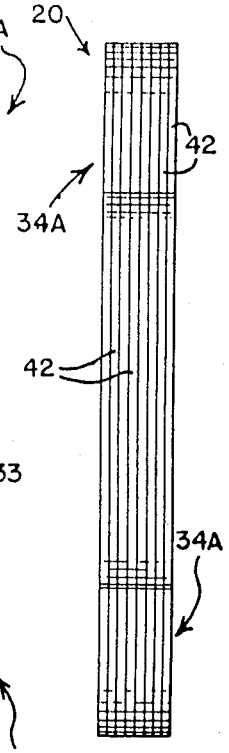
FIG. 5 is an elevational view of the spine end of the book, showing the inside edges of the panels making up the book of FIGS. 1-5.

In accordance with the invention, the outside edges 38 of the panels 22 that are consecutively subsequent to the front panel 22 include edge portions 38A that are consecutively progressively indented incrementally and equally, toward the book spine 34, so that the outside edging 38 of the book panels 22, starting with the first inside panel 22, are in recessed edging form, exposing a panel edge portion 38A of the panel 22 immediately preceding same in the book 20 that is thus on the back side of such immediately preceding panel 22. In the book 20 the entire edging 38 of the respective book panels 22 subsequent to the book front panel (the panel 22 that forms the book front cover) is indented the same amount for the height of the book, as indicated in FIG. 4, with each panel 22 of the book 20, following the book front panel, being indented toward the book spine successive increments of approximately ⅛th of an inch in a successful embodiment of the invention (while increments on the order of ⅛ inch are recommended, the increments for any one board book can lie in the range of from about 1/16 inch to about ¼ inch, but such increments for any one board book should be approximately equal.

The result is that the edging 38 of each pair of swingably connected panels 22 that is disposed in front of a succeeding panel 22 in defining an edge portion 38A, defines a panel turning surfacing 39 with the turning surfacings 39 being aligned transversely of the book; when the book lies flat and closed on (for instance) the flat surface of a table or the like, ready consecutive engagement of the consecutive book panels is provided for to consecutively swing them from their book closed relation shown in FIGS. 1–6 to their book open relations, illustrated in FIGS. 7–10, and about the respective folds 35.

A feature of the present invention is that the panels 22, being formed of several layers of paperboard or the like, in addition to being essentially planar (see for instance FIGS. 2, 3, and 5–10, are each relatively stiff or rigid, except for the fold 35 that forms panel connections at the book spine 34, so that, for instance, when the board book 20 is disposed to be closed and lie horizontally flat, as on a table or floor (the position of FIGS. 1, 3, and 6), as the front panel 22 is swung about its fold 35 at the book spine 34, by the youngster engaging the panel turning edging 39 of the book front panel 22, the indicated front panel 22 is swung approximately 90 degrees upwardly about such fold 35, from which it drops, or can be dropped, to the book open relation shown in FIGS. 7 and 8, wherein the book front panel arrives at a flat and substantially horizontal, upwardly facing open book relation in substantial coplanar relation with the second book panel 22, with the first and second book panels having their inside edges 42 in substantial abutting relation at the book spine and below the pivot axis 35 in question, as indicated in FIG. 8.

When the next adjacent panel 22 of the book 20 is opened in the same manner (this is the panel shown at the right hand side of FIGS. 7 and 8 in upwardly facing relation) the same opening and positioning action occurs, as indicated in FIGS. 9 and 10. The remaining panels 22 of the book are moved to and disposed in their book open relation in the same manner, successively covering, and thus closing, the book panels that have already opened and viewed.

In each open position of the book defined by a pair of adjacent book panels 22, the rear face of a forwardly disposed panel 22 becomes aligned in substantial coplanar relation with the forward face of the next adjacent but rearwardly disposed book panel 22 to provide a full spread out imprinting space across these panels that faces upwardly toward the viewer for application to the respective panels of separate imprinting wording and art work as shown in FIG. 7, or a single piece of art work applied to both upwardly facing faces of the panels 22 at the open relation of the book, or any combination of imprinting including printed matter of art work that would need to be of motivating interest to preschoolers.

In the embodiment of FIGS. 11–13, the book 60 has the same edgings as the book 20, and the panels 62 of book 60 have the same edges as book 20. However, the board book 60 at its outside edging 26 has its panel edges 38 that are disposed consecutively rearwardly of the front panel 62 indented incrementally (toward the book spine 34) to define recessed edge portions 38B for a height less than the height of the book 60, as indicated in FIG. 12, so as to define panel turning portions 39 that, while being aligned transversely of the book, extend only a portion of the height of the book, though they are centered in the form of the book 60 shown in FIGS. 11–13, between the upper and lower edgings 24, 28 of the book.

The spine 34 of the book 60 is also indented toward the outside edging 26 of the book 60 so that the cardboard sheets that form the adjacent pairs of panels 62 swing about the indicated fold lines 35 at the spine upper and lower sections 34A, which are respectively concentric with the aforementioned pivot axes 35, similar to board book 20.

The consecutive pairs of attached panels 22 and 64 may be bound together in any suitable conventional manner, such as the duplex glued binding procedure that is performed conventionally on an Ehlerman duplex binder, a procedure that is employed for binding board books by Western Publishing Company of Racine, Wisc.

The board book 60 opens up to its open relation for the various book panels 62 involved in the same manner as indicated in FIGS. 7–10.

It will therefore be seen that the board books of the invention enables preschool children, which in the nature of things have limited motor skills, to use only an open hand to turn the pages of such book. The set back nature of the edges 38 of, for instance, the book panels 22 following the book front panel makes it easy for the preschooler to use his open hand to engage the book respective overhanging edge portions 38A, when the book is closed and lies flat, as when resting on a table top with the book panel 22 that serves as the rear cover of the book engaging the table surface. This disposes the panel edges 38 to the right of the book spine, for instance, the spine 34 of the book 20, so that the preschooler can readily and consecutively engage the respective panels 22 of the book (at their respective turning surfaces 39) and swing them at least beyond an upright position after which the individual panels 22 fall flat, to the left of the book spine 34, as indicated in FIGS. 8 and 10, and about the fold 35 between the panel just swung and the next adjacent panel, which fold 35 extends parallel to the book spine 34 and thus heightwise of the book. This disposes the individual panels 22 that have been moved to the book open position (see FIGS. 8 and 10, for instance) wherein the open panel 22 is in substantial coplanar relation with the panel 22 that is adjacent to it when the book is closed so that the rear face of the open panel and the front face of the panel that has nor yet been swung to the open position are largely in coplanar relation also, with the opened panel being braced at its inside edge 42 against the inside edge 42 of the panel next to it. This relation obtains for the consecutive panels of the book as they are swung to the open position (compare FIGS. 8 and 11), and also for the board book modification shown in FIGS. 11–13.

It will thus be seen that in accordance with the invention the individual panels that make up the pages of the board book of this invention are turned easily by the preschooler even though children of that age cannot effectively grasp either the unturned or turned panel of the book. Nevertheless, when the individual panels of the book are turned, the panel that has been turned and the panel next adjacent to it provide a full spread area for application thereto of indicia of the type indicated in FIGS. 7 and 9 that promote the interest of the child in the edition that is involved, resulting in the facilitating of learning of simple words, sequential learning, and developing coordination as a result of the book page turning action, or paging, that takes place as the child works his way through the book.

This is done without adult assistance and does not require the child to hold down both pages of the book to achieve the flattened relation of both pages that is indicated in FIGS. 7 and 9.

It will be apparent that board books of the present invention in addition to containing the indicia and/or art work that has been referred to, can also contain poems, nursery rhymes, and illustrated stories as well.

The different shapings of the board book of the present invention are illustrated by the drawing figures provided, from which it can be seen that the corners of the book can either be squared or rounded, and that the book may be generally quadrilateral in configuration. As a matter of choice, the book may be rectangular in configuration either vertically or horizontally, or it may be approximately square, as indicated in the case of book 20.

In making each book, the individual panels are fabricated and the edges 38 and edge portions 38A or 38B are defined, in accordance with the style of board book to be made, after which the individual panels of the book are bound together utilizing one of the commercially available binding procedures that have been indicated where appropriate. The board book panels are then either die cut or mechanically cut to the desired shape, variations of which are shown in the drawings or have been referred to in the description hereinbefore.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. In a board book for preschool children and having a front and a rear, said board book in its closed relation comprising:

a plurality of generally quadrilateral, essentially planar, panels of similar size and configuration, in side-by-side congruent relation, with the panel of said panels forming the front of the book being the book front panel, and the panel of said panels forming the rear of the book being the book rear panel, each of said panels defining a top edge, an outside edge, a bottom edge, and an inside edge.

means for binding said panels together at their inside edges forming the spine of said book and for connecting consecutive of said panels to said spine for approximately one hundred eighty degrees free swinging movement relative to said spine from positioning at one side of said spine to the other side of said spine to form the respective open relations of the book, said book defining a top edging, an outside edging, a bottom edging, and an inside edging, with said spine being at said book inside edging, with those of said book panels, following said book front panel, at their respective said outside edges and at the outside edging of said book, being consecutively progressively indented toward said book spine, through said rear panel, to define for each of said indented panels a recess edging exposing a panel turning surfacing portion of the panel preceding same in said book, said panel turning surfacing portions being substantially aligned transversely of said book and comprising means for swinging the respective panels relative to said spine to provide the respective book open relations, and with at least those of said book panels intermediate said book front and rear panels each defining a front face and a rear face each bearing indicia means for facilitating by observation preschooler sequential learning, whereby, when the book in its closed relation is lying flat in an essentially horizontal disposed relation on said rear panel thereof, a preschooler to page through the book may consecutively swing said book panels to form the book consecutive open relations, starting with said front panel thereof, and down to said rear panel thereof, by manually and consecutively engaging the respective panel turning surfacing portions of the respective book panels, from one side of said book spine at least beyond an upright position relative to said book spine and allow such swung panel to fall flat on the other side of said spine, to dispose in substantial horizontal open book relation and expose for preschooler viewing said rear face of such swung panel and the front face of such next succeeding panel of said panels of the book, free of any manual hold down of any of said panels, free of any manual gripping by the preschooler of any of such swung panels, and free of any adult assistance in exposing said faces of said panels, whereby such swung panel rear side, and such succeeding panel front side, in paging through the book, provide full spread areas bearing said indicia means that are consecutively openable for viewing by the preschooler paging said panels through the book from the front to the rear of the book.

2. The board book set forth in claim 1 wherein:

said binding means connects said panels to said book spine such that in paging through the book to form the consecutive open relations of the book, such swung panel and such succeeding panel are in substantial coplanar relation.

3. The board book set forth in claim 1 wherein:

said panel recess edgings extend the height of the book.

4. The board book set forth in claim 1 wherein:

said panel recess edgings extend a limited portion of the height on the book and are aligned transversely of the book.

5. The board book set forth in claim 1 wherein:

said spine of the book extends uniformly the height of the book.

6. The board book set forth in claim 1 wherein:

said spine of the book is indented toward its said outside edging intermediate the book said top and bottom edgings.

7. The board book set forth in claim 2 wherein:

said panels at said book spine are articulated thereto by flexible folds.

* * * * *